United States Patent [19]

Ikeura

[11] 4,401,087

[45] Aug. 30, 1983

[54] METHOD AND APPARATUS FOR ENGINE CONTROL

[75] Inventor: Kenji Ikeura, Yokosuka, Japan

[73] Assignee: Nissan Motor Company, Ltd., Kanagawa, Japan

[21] Appl. No.: 249,743

[22] Filed: Mar. 31, 1981

[30] Foreign Application Priority Data

Apr. 3, 1980 [JP] Japan ..... 55-42843

[51] Int. Cl.[3] ..... F02D 5/02

[52] U.S. Cl. ..... 123/492; 123/493; 123/480; 364/431.07

[58] Field of Search ..... 123/492, 493, 480; 364/431.07, 431.05

[56] References Cited

U.S. PATENT DOCUMENTS

| | | | |
|---|---|---|---|
| 3,581,723 | 6/1971 | Scholl | 123/492 |
| 4,184,458 | 1/1980 | Aoki et al. | 123/492 |
| 4,191,137 | 3/1980 | Williams et al. | 123/492 |
| 4,245,605 | 1/1981 | Rice et al. | 123/492 |
| 4,257,377 | 3/1981 | Kinugawa et al. | 123/493 |
| 4,313,412 | 2/1982 | Hosaka et al. | 123/480 |

*Primary Examiner*—Craig R. Feinberg
*Assistant Examiner*—Andrew M. Dolinar
*Attorney, Agent, or Firm*—Schwartz, Jeffery, Schwaab, Mack, Blumenthak & Koch

[57] ABSTRACT

A method and apparatus for controlling an internal combustion engine having at least one cylinder adapted to intake, during each intake stroke of the cylinder, fuel supplied in a plurality of instalments. Means is provided for controlling the amount of fuel supplied to the engine. Adjustments of the control means are produced by generating electrical signals indicative of engine operating conditions, and, with a digital computer, repetitively calculating values corresponding to settings of the control means. The digital computer is programmed to calculate a basic value from an algebraic function describing a desired relationship between the engine conditions and the basic value, detect engine acceleration and deceleration conditions from changes in the engine conditions, and add a positive or negative value to the calculated basic value when the engine is accelerating or decelerating to correct the calculated basic value for the detected acceleration and deceleration conditions.

20 Claims, 11 Drawing Figures

METHOD AND APPARATUS FOR ENGINE CONTROL

BACKGROUND OF THE INVENTION

1. Field of the Invention

This invention relates to a method and apparatus for the control of an internal combustion engine having means for controlling the amount of fuel supplied to the engine and including at least one cylinder adapted to intake, during each intake stroke of the cylinder, fuel supplied in a plurality of instalments.

2. Description of the Prior Art

In internal combustion engines equipped with a fuel injection system of the type producing, in synchronism with engine rotation, simultaneous fuel injection for all of the cylinders, each cylinder intakes the fuel injected in a plurality of instalments during an intake stroke of the cylinder. The amount of fuel injected for a duration of fuel injection is determined by sensing selected engine operating conditions such as, for example, engine speed and intake airflow and calculating the amount of fuel required for the engine in terms of the sensed engine operating conditions. In the acceleration and deceleration modes of engine operation, however, rapid changes occur in such engine operating conditions to produce a deviation between the required fuel amount and the amount of fuel actually supplied to the cylinder. This creates an overlean air-fuel mixture resulting in poor acceleration power and engine stalling or an overrich air-fuel mixture resulting in increased exhaust emissions and possibly backfire.

The present invention provides a method and apparatus suitable for use in an internal combustion engine having at least one cylinder adapted for intaking, during each intake stroke of the cylinder, fuel supplied in a plurality of instalments to eliminate engine operating instabilities particularly in the acceleration and deceleration modes of operation, thereby producing equilibrium conditions of engine operation at all times.

SUMMARY OF THE INVENTION

The present invention provides a method and apparatus for controlling an internal combustion engine having an output shaft means for controlling the amount of fuel supplied to the engine, and at least one cylinder adapted to intake, during each intake stroke of the cylinder, fuel supplied in a plurality of instalments. While the engine is operative, electric signals are generated which are indicative of conditions of the engine. From these electrical signals indicative of conditions of the engine, a value corresponding to a setting of the means for controlling the amount of fuel supplied to the engine is calculated. The calculation is carried out by arithmetically calculating a basic value from an algebraic function describing a desired relationship between the engine condition and the basic value, detecting engine acceleration and deceleration conditions from changes in the engine conditions, and correcting the calculated basic value for the detected acceleration and deceleration conditions. The correction is made by adding a positive value to the calculated basic value when the engine is accelerating and a negative value when the engine is decelerating. The calculated value is converted into a setting for the means for controlling the amount of fuel supplied to the engine. While the engine is in operation, the above operation is continuously repeated at uniform angular intervals of rotation of the engine output shaft to effect changes in the setting of the means for controlling the amount of fuel supplied to the engine in response to changes in the electrical signals indicative of the engine conditions.

The apparatus of the invention includes a control circuit connected to the means for sensing the varying engine conditions and coupled to an electrical circuit used to adjust the settings of the means for controlling the amount of fuel supplied to the engine. The control circuit repetitively calculates values corresponding to settings for the means for controlling the amount of fuel supplied to the engine. The control circuit has a digital computer programmed to calculate a basic value from an algebraic function describing a desired relationship between the sensed engine conditions and the basic value, detect engine acceleration and deceleration conditions from changes in the sensed engine conditions, and add a positive or negative value to the calculated basic value when the engine is accelerating or decelerating to correct the calculated basic value for the detected acceleration or deceleration condition. The results of the repetitive calculations are transformed by the electrical circuit into adjustments of the means for controlling the amount of fuel supplied to the engine.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Before describing the specific structure of the fuel injection control system of the present invention, the operation of an internal combustion engine equipped with a simultaneous injection type fuel injection system will be described in order to specifically point out the difficulties attendant therewith.

Figure 1A:
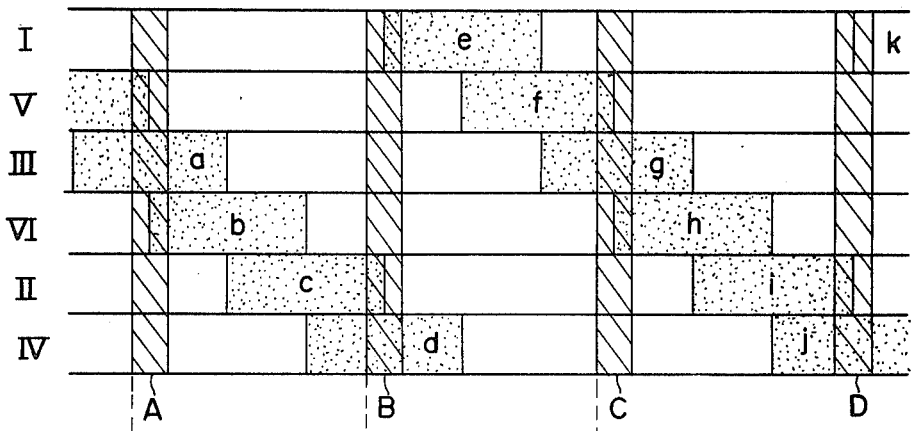
FIG. 1 contains two diagrams 1*a* and 1*b* used in explaining the operation of an internal combustion engine equipped with a simultaneous injection type fuel injection system.

FIG. 1*a* is a diagram showing the relationship between fuel injection timing and cylinder intake stroke timing provided for a six-cylinder engine equipped with a simultaneous injection type fuel injection system. It is assumed that fuel is injected into the intake manifold once per engine rotation during the fuel injection durations indicated by the hatched areas A, B, C and D, and is sucked into the cylinders I to VI during the corresponding cylinder intake stroke durations, indicated by the dotted areas a to k. For example, during the cylinder intake stroke duration e, the cylinder I intakes the fuel injected in the two instalments made during the injection durations A and B. It is to be understood that the amount of fuel injected into the intake manifold for each injection duration (hereinafter referred to as the injected fuel amount) be one-half the amount of fuel required for the engine (hereinafter referred to as the required fuel amount). The required fuel amount is calculated from an algebraic relationship which specifies this controlled variable in terms of engine speed and intake airflow. When rapid changes occur in such engine operating conditions, a deviation occurs between the required fuel amount and the amount of fuel supplied to the cylinder (hereinafter referred to as the supplied fuel amount).

Figure 1B:
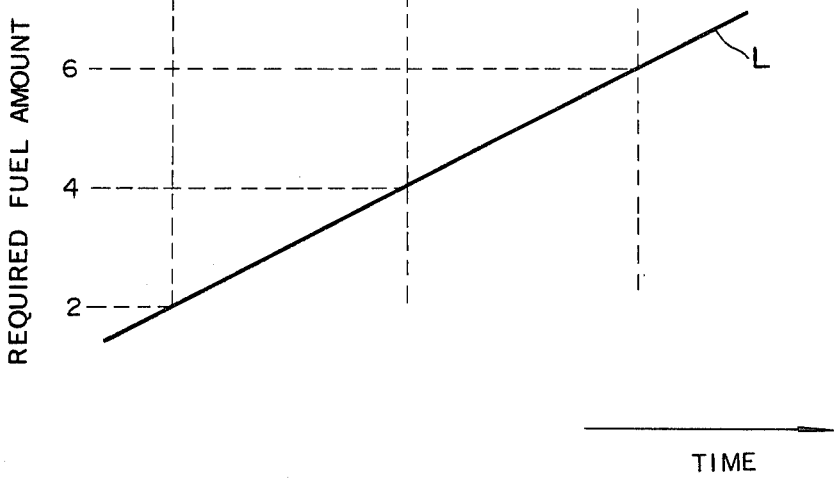

For example, if the engine is accelerating and the required fuel amount increases with time, as indicated by the line L of FIG. 1*b*, the required fuel amount is 2 and the injected fuel amount is $2\times\frac{1}{2}=1$ during the injection duration A. During the injection duration B, the required fuel amount is 4 and the injected fuel amount is $4\times\frac{1}{2}=2$. Thus, the amount of fuel sucked into the cylinder I during the intake stroke duration e is $1+2=3$ in spite of the fact that the required fuel amount for the cylinder is 4 during this duration. As a result, the air-fuel mixture charge in the cylinder I becomes lean as compared to the desired air/fuel ratio. In a deceleration mode of engine operation where the required fuel amount decreases with time, the air-fuel mixture charge in the cylinder becomes rich as compared to the desired air/fuel ratio.

Figure 2:
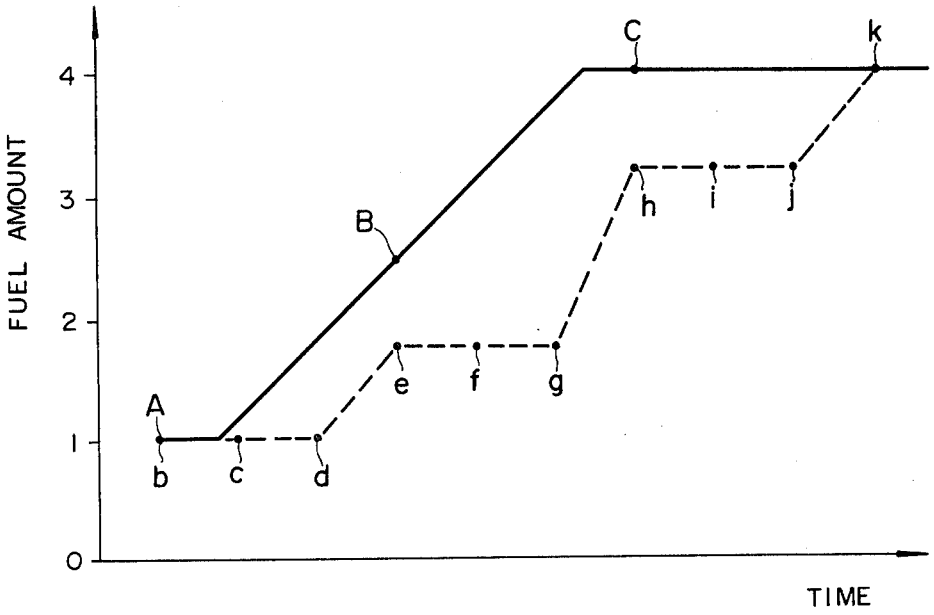
FIG. 2 is a graph showing the relationship between required fuel amount and sucked fuel amount in the presence of acceleration condition.

FIG. 2 is a graph showing the relationship between required fuel amount and supplied fuel amount in the presence of an acceleration condition. The solid lines illustrate variations in the required fuel amount and the broken lines illustrate variations in the supplied fuel amount. Reference points A, B and C indicate the injected fuel amounts during the respective injection durations A, B and C. Reference points b to k on the broken lines indicate the supplied fuel amounts during the respective intake stroke durations b to k. The supplied fuel amount is the total amount of fuel injected in two instalments and thus is equal to the average value of the injected fuel amount during an injection duration and the injected fuel amount during the proceding injection duration. For example, the supplied fuel amount e is given as $e=A/2+B/2$.

As can be seen by a study of FIG. 2, although the injected fuel amount fairly corresponds to the required fuel amount, the sucked fuel amount is rather less than the required fuel amount in the presence of an acceleration condition. This creates an overlean air-fuel mixture resulting in poor accelerating power and engine stalling. On the contrary, the sucked fuel amount is larger than the required fuel amount in the presence of a deceleration condition. This creates an overrich air-fuel mixture resulting in increased exhaust emissions.

Figure 3:
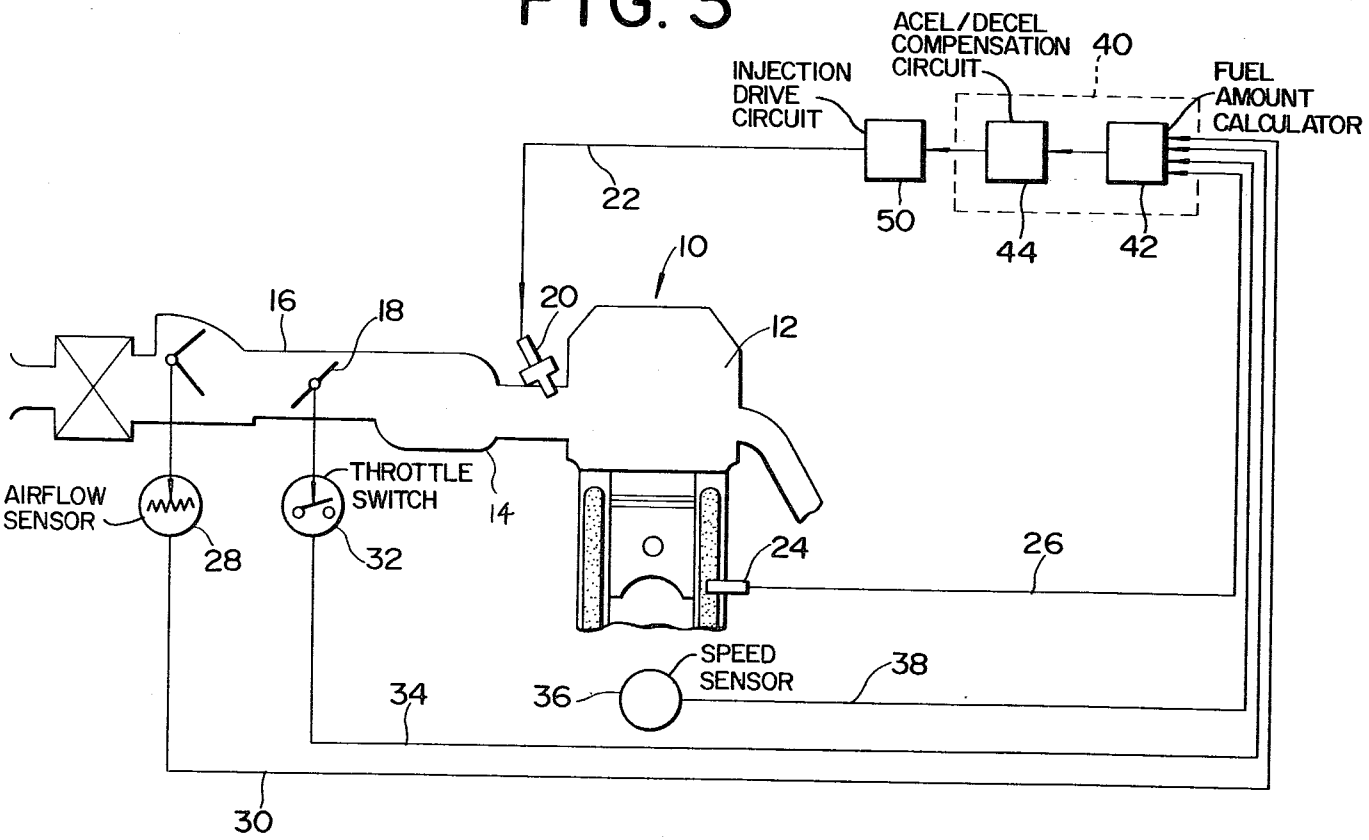
FIG. 3 is a schematic block diagram showing a fuel injection control system embodying the present invention.

Referring to FIG. 3, there is shown a schematic block diagram of a fuel injection control system embodying the present invention. An internal combustion engine, generally designated by the numeral 10, for an automotive vehicle includes a combustion chamber or cylinder 12. An intake passage 16 is connected with the combustion chamber 12 through an intake manifold 14. The amount of air permitted to enter the combustion chamber 12 through the intake manifold 14 is controlled by a butterfly throttle valve 18 located in the intake passage 16.

A fuel injector, designated by the numeral 20, is provided for injecting a controlled amount of fuel into the intake manifold 14. The fuel injector 20 may be of the type including a housing communicated through a fixed metering orifice with the intake manifold 14, a solenoid, and a plunger supported within the housing for reciprocation between a fully-open position and a fully-closed position. When the solenoid is energized by the presence of electrical current within it, the plunger moves toward the fully-open position. The length of the electrical pulse, that is, the pulse-width, applied to the solenoid determines the length of time the plunger is in its open position and, thus, determines the amount of fuel injected through the orifice into the intake manifold 14.

The amount of fuel metered to the engine is determined by the width of the electrical pulses applied on the line 22 to the fuel injector 20. This pulse width is determined from arithmetic calculations performed by a digital computer. These calculations are based upon various conditions of the engine that are sensed during its operation. These sensed conditions include cylinder-head coolant temperature, throttle position, engine load, and engine speed. Other conditions may include ambient temperature, ambient air pressure, humidity, transmission gear position, battery voltage, and the like.

A cylinder-head coolant temperature sensor 24 is connected by a line 26 to the digital computer. The cylinder-head coolant temperature sensor 24 preferably is a thermistor device mounted in the engine cooling system. It is connected in an electrical circuit capable of producing a DC voltage having a variable level proportion to coolant temperature.

A DC electrical signal having voltage proportional to air flow through the intake passage 16 is provided by an airflow sensor 28 connected by a line 30 to the digital computer. A throttle switch 32, connected by a mechanical link to the throttle valve 18, is connected by a line 34 to the digital computer. The throttle switch 32 produces a DC electrical signal when the engine is at idle or the throttle valve 18 is in its fully-closed position.

The speed of rotation of the engine is sensed by a speed sensor 36. The speed sensor 36 may be in the form of a crankshaft position sensor adapted to produce a series of crankshaft position electrical pulses. Each pulse corresponds to a predetermined number of degrees of rotation of the engine crankshaft, and the pulses are produced at a repetition rate directly proportional to engine speed. The engine speed signal is applied by a line 38 to the digital computer.

The digital computer is included in a fuel injection control circuit 40 adapted to calculate a value corresponding to a setting of the fuel injector from the electrical signals indicative of conditions of the engine. The digital computer is capable of performing the arithmetic calculations of addition, subtraction, multiplication, and division on binary numbers. The digital computer comprises a central processing unit (CPU), a read only memory (ROM), a random access memory (RAM), and an input-output unit.

The fuel injection control circuit 40 comprises first and second sections 42 and 44. In the first section 42, the basic fuel amount is calculated by the digital computer central processing unit. This arithmetic calculation is made with the use of an algebraic relationship that specifies this control variable as a function of engine speed and intake airflow. The calculated basic fuel amount is corrected for cylinder-head coolant temperature and other sensed conditions to provide a value corresponding to the required fuel amount. The basic fuel amount $\alpha$ is represented by $\alpha = K \cdot (Q/N)$ where Q is the intake airflow, N is the engine speed, and K is a constant. The second section 44 compensates the corrected value for the acceleration or deceleration condition by adding a positive or negative value to the corrected value when the engine is accelerating or decelerating.

An injector drive circuit 50 interconnects the fuel injection control circuit 40 with the fuel injector 20. The injector drive circuit 50 provides an electrical signal of pulse-width corresponding to the value calculated by the fuel injection control circuit 50 to the fuel injector 20.

Figure 4:
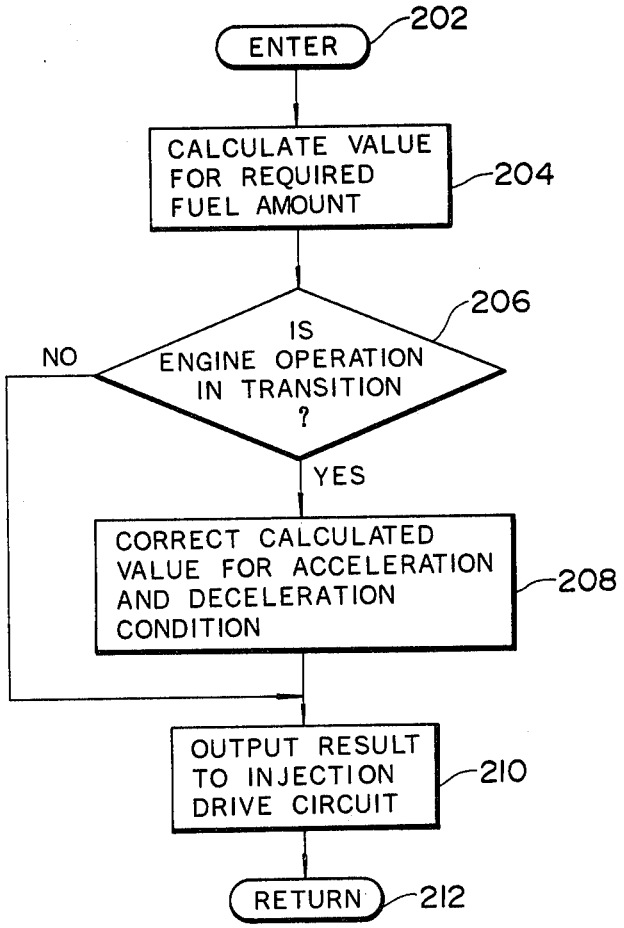
FIG. 4 is an overall flow diagram illustrating the programming of the digital computer used in the present invention.

FIG. 4 is an overall flow diagram illustrative of the programming of the digital computer included in the fuel injection control circuit 40. The computer program is entered repetitively at the point 202 in synchronism with engine rotation, for example, once per engine rotation. At the point 204 in the program, a value is obtained for the required fuel amount by calculating a value for the basic fuel amount from an algebraic relationship which specifies this controlled variable in terms of engine speed and intake airflow, and correcting the calculated basic fuel amount value for cylinder-head coolant temperature.

At the following point 206, a determination is made as to whether the engine operation is in transition. If the answer to this question is "yes", it means that the engine is accelerating or decelerating, and the program proceeds to the point 208 where the calculated basic fuel amount value is corrected for an accelerating or decelerating condition. Following this, the program proceeds to the point 210 where the corrected value is outputted to the injection drive circuit 50. If the determination at the point 206 is "no", then at the point 210, the calculated required fuel amount value is outputted to the injection drive circuit 50.

Figure 5:
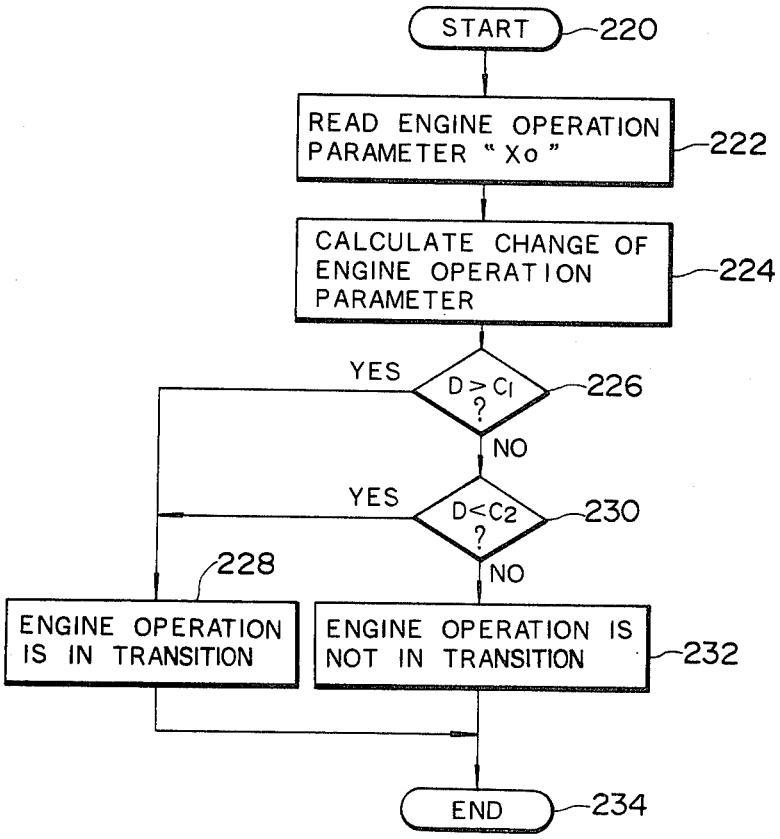
FIG. 5 is a detailed flow diagram illustrating the programming of the digital computer performed for the decision step in the FIG. 4 computer program.

FIG. 5 is a detailed flow diagram illustrating the programming of the digital computer performed for the decision step at the point 206 of FIG. 4. The computer program starts at the point 220. At the point 222 in the computer program, a parameter Xo of engine operation is read into the memory. The parameter may be at least one of the engine operating conditions including throttle position, intake airflow, and intake manifold pressure. Alternatively, the variable may be the basic fuel amount, that is, the basic pulse width, calculated as a function of engine speed and one of throttle position, intake airflow, and intake manifold pressure. At the point 224, a difference $D = Xo - Xb$ is obtained by subtracting the parameter Xb which is the previous value of parameter Xo. At the point 226, a determination is made as to whether the difference D is larger than a predetermined positive value C1. If $D > C1$, the program proceeds to the point 228 where the engine operation is deemed to be in transition (acceleration). If $D \leqq C1$, then at the point 230, another determination is made. This determination is whether or not the difference D is less than a predetermined negative value C2. If the answer to this question is "yes", then the program proceeds to the point 228 where the engine operation is deemed to be in transition (deceleration). If the answer to this question is "no", that is, $C1 > D > C2$, then at the point 232, the engine operation is deemed to be out of transition.

As can be seen from FIG. 5, the engine operation is deemed to be in transition in the case where a change of an engine operating parameter occurring in the interval between executions of the computer program of FIG. 5 is larger than a predetermined value. For example, if the computer program is executed at intervals corresponding to fuel injection timing, the difference D represents a change of an engine operating parameter which occurs in an interval between two successive fuel injections. If the computer program is executed at regular intervals, for example, of 10 ms, the difference D represents a change of an engine operating parameter occurring in a constant interval. If the computer program is executed at uniform intervals of crankshaft angular rotation, the difference D represents a change of an engine operating parameter occurring in an interval during which the crankshaft rotates through a predetermined angle. In order to calculate values which accurately control the amount of fuel supplied to the engine, no delay in response to changes in engine operating condition should occur. Therefore, the frequency of execution of the computer program is preferably made as high as possible.

Figure 6:
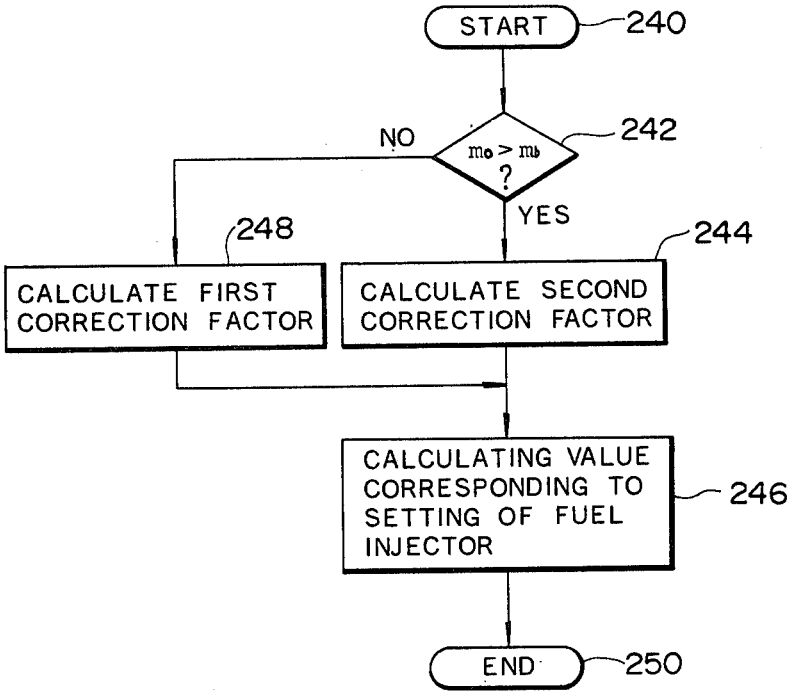
FIG. 6 is a detailed flow diagram illustrating the programming of the digital computer performed for the correction step in the FIG. 4 computer program.

FIG. 6 is a detailed flow diagram illustrative of the programming of the digital computer performed for the correction step at point 208 of FIG. 4. The computer program starts at the point 240. At the point 242 in the computer program, a determination is made as to whether the required fuel amount value $m_o$, which was calculated at the point 204 in the FIG. 4 computer program, is larger than the required fuel amount value $m_b$, which was calculated at the same point 204 but in the preceding program execution. If the answer to this question is "yes", the program proceeds to the point 244 where a first correction factor $f1 = K1(m_o - m_b)$ is calculated wherein K1 is a positive constant equal to or less than 1. In this case, the first correction factor f1 is positive since $m_o > m_b$ in the presence of an acceleration condition. At the following point 246, a value Mo corresponding to a setting of the fuel injector 20 is calculated by adding the calculated first correction factor F1 to the required fuel amount value $m_o$.

If the determination at the point 242 is "no", then the program proceeds to the point 248 where a second correction factor $f2 = K2(m_o - m_b)$ is calculated wherein K2 is a positive constant equal to or less than 1. In this case, the second correction factor f2 is negative since $m_o < m_b$ in the presence of a deceleration condition. At the following point 246, a value Mo corresponding to a setting of the fuel injector 20 is calculated by adding the calculated second correction factor f2 to the required fuel amount value $m_o$.

Figure 7:
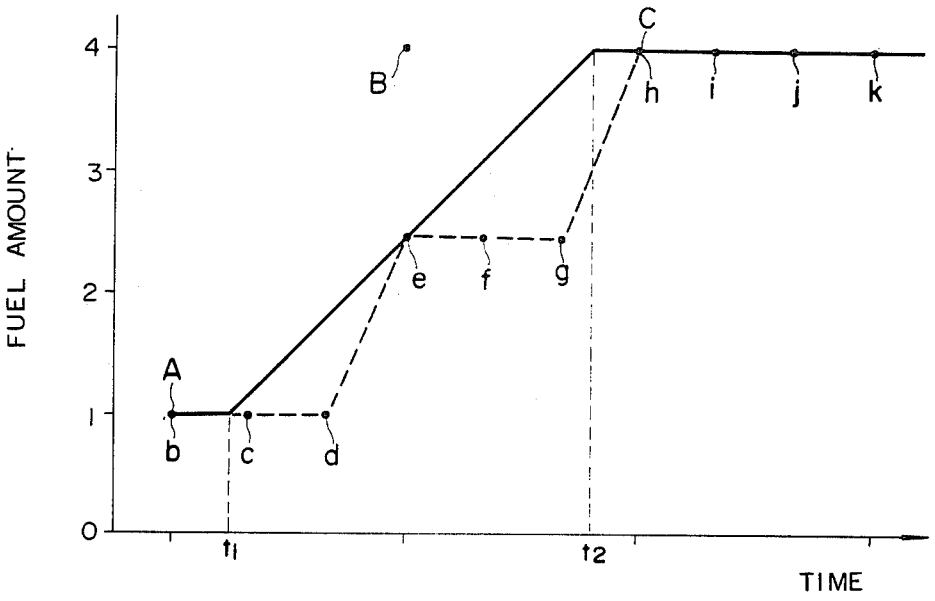
FIG. 7 is a graph showing the relationship between required fuel amount and sucked fuel amount with the required fuel amount being corrected for an acceleration condition in accordance with the present invention.

FIG. 7 is a graph illustrating the relationship between required fuel amount and supplied fuel amount. The required fuel amount is corrected with the use of first and second correction factors f1 and f2 wherein both of the constants K1 and K2 are set to 1. The solid lines illustrate variations in the required fuel amount and the broken lines illustrate variations in the supplied fuel amount.

The transition condition where the engine is accelerating in the illustrated case is detected at time t1 by the FIG. 5 computer program and the required fuel amount for the injection duration B is corrected at the point 246 in the FIG. 6 computer program. Since the constant K1 is set to 1, the first correction factor f1 is equal to $m_o - m_b = 2.5 - 1.0 = 1.5$ and the value corresponding to the setting of the fuel injector 20 is calculated at $2.5 + 1.5 = 4$. Thus, the injected fuel amount B is 4 during the injection duration B and the sucked fuel amount e is $\frac{1}{2}(1+4) = 2.5$ during the intake stroke duration e. The supplied fuel amount is equal to the required fuel amount. At time t2, the termination of the acceleration condition is detected and the FIG. 6 computer program is ended at the point 250.

It can be seen from a comparison of FIG. 7 with FIG. 2 that the fuel injection control circuit of the present invention is capable of bringing the supplied fuel amount much closer to the required fuel amount, although the supplied fuel amount values c, d, f and g are somewhat less than the corresponding required fuel amount values since the time period during which the engine is accelerating is very short.

If the interval of execution of the computer program for detecting changes in engine operating conditions is long, the control circuit fails to detect the termination of the acceleration condition at time t2. This produces a tendency of the supplied fuel amount to exceed the required fuel amount until the termination of the acceleration condition is detected, resulting an overrich air-fuel mixture. This tendency can be eliminated by setting the constants K1 and K2 to a positive value less than 1.

Figure 8:
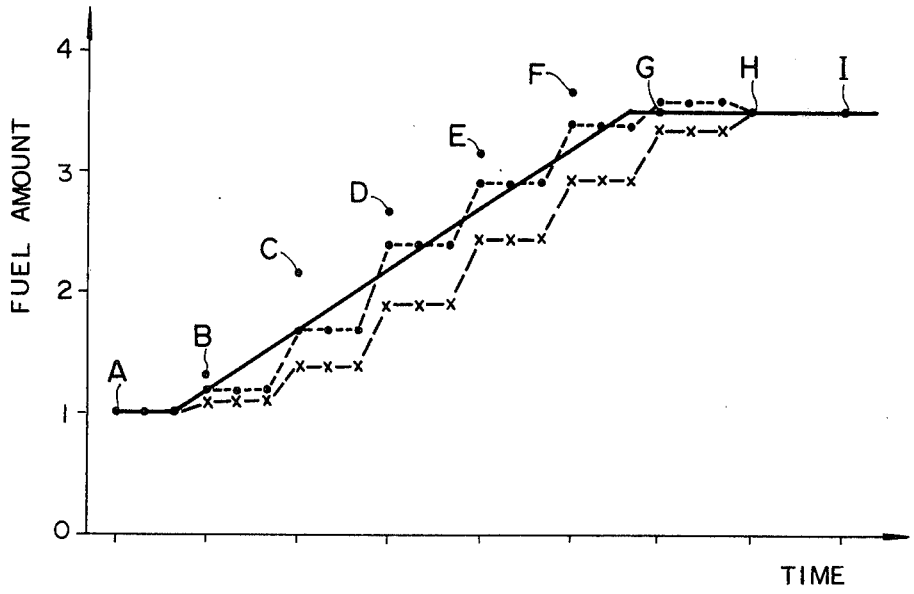
FIG. 8 is a graph showing, in reduced time scale, the relationship between required fuel amount and sucked fuel amount and showing comparative performances of two engines, one operated in accordance with the present invention, and the other operated in a conventional manner.

FIG. 8 is a graph illustrative of the relationship between required fuel amount and supplied fuel amount in case where the time period during which the engine is accelerating is relatively long. The required fuel amount is corrected with the use of first and second correction factors f1 and f2 wherein both of the constants K1 and K2 are set to 1. The solid lines illustrate variations in the required fuel amount. The broken lines with dot marks thereon illustrate variations in the supplied fuel amount with the calculated required fuel amount values being corrected for an acceleration condition in accordance with the present invention. The broken lines with x marks thereon illustrate variations in the supplied fuel amount without the calculated required fuel amount values being corrected for an acceleration condition. Reference points A to I indicate the injected fuel amounts during the respective injection durations A to I.

From FIG. 8, it can be seen that the present invention can bring the supplied fuel amount much closer to the required fuel amount. If the acceleration condition continues for a relatively long time, however, there is a tendency of the supplied fuel amount to exceed somewhat the required fuel amount, resulting in an overrich air-fuel mixture. This tendency can be eliminated by calculating the first correction factor f1 as $f1 = K1(m_o - M_b)$ at the point 244 in the computer program of FIG. 6 and calculating the second correction factor f2 as $fe = K2(m_o - M_b)$ at the point 248 in the computer program of FIG. 6. The letter $M_b$ indicates a value corresponding to the preceding setting of the fuel injector 20 which has been calculated at the point 246 in the FIG. 6 computer program but in the preceding program execution.

Figure 9:
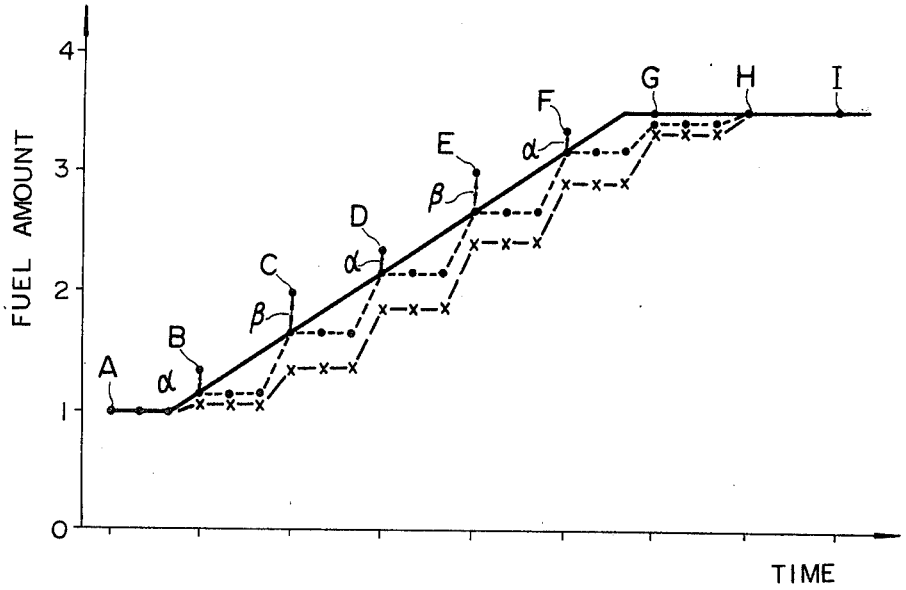
FIG. 9 is a graph illustrating, in reduced time scale, the relationship between required fuel amount and sucked fuel amount and showing comparative performances of two engines, one operated in accordance with the present invention, and the other operated in a conventional manner.

FIG. 9 is a graph showing the relationship between required fuel amount and supplied fuel amount in the case where the first correction factor f1 is calculated as $f1 = (K1(m_o - M_b)$ and the second correction factor f2 is calculated as $f2 = K2(m_o - M_b)$. The solid lines illustrate variations in the required fuel amount. The broken lines with dot marks thereon illustrate variations in the supplied fuel amount with the calculated required fuel amount values being corrected in accordance with the present invention. The broken lines with x marks thereon illustrate variations in the supplied fuel amount without the calculated required fuel amount values being corrected. Reference points A to I designate the injected fuel amounts during the respective injection durations A to I.

From FIG. 9, it can be seen that in this manner the supplied fuel amount is brought much closer to the required fuel amount without the supplied fuel amount exceeding the required fuel amount. Since the first and second correction factors f1 and f2 change periodically as indicated by the letters $\alpha$ and $\beta$ in FIG. 9, however, there would be some torque fluctuations.

Correction of calculated values for acceleration and deceleration onditions is not required when the engine speed is high since the time interval between successive fuel-injections decreases as the engine speed increases. Further, it becomes difficult to detect changes in engine operating conditions which occur while the engine runs at high speeds. Thus, it is desirable to stop such correction when the engine speed exceeds a predetermined value.

Figure 10:
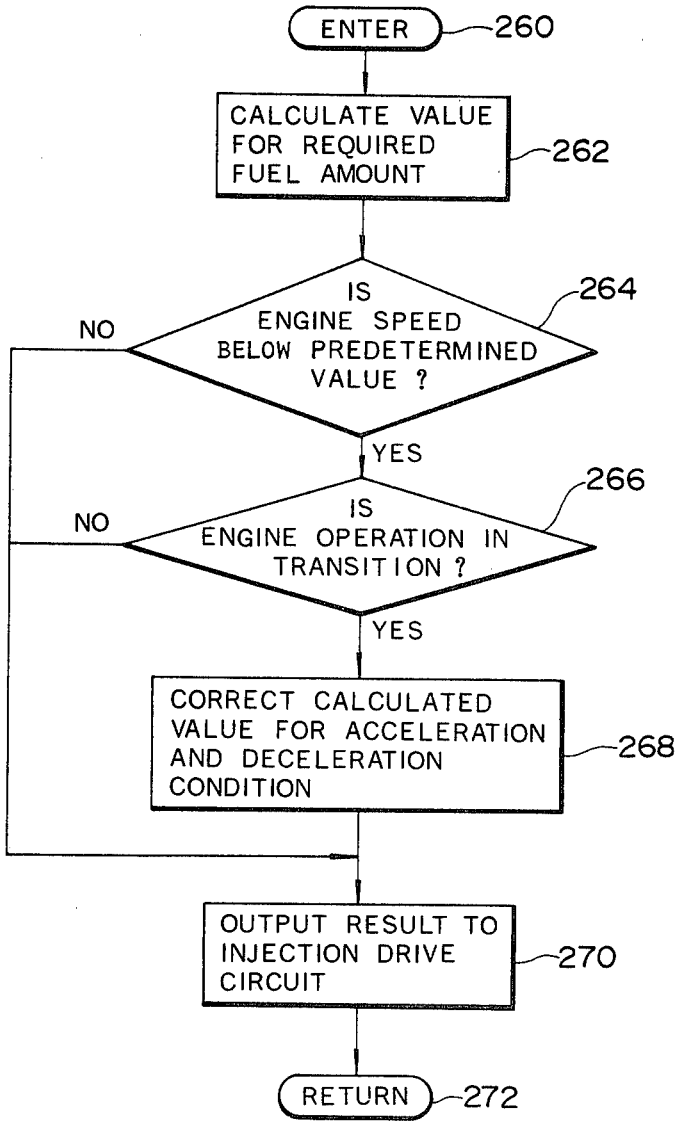
FIG. 10 is an overall flow diagram illustrating a modified form of the programming of the digital computer used in the present invention.

FIG. 10 is an overall flow diagram illustrating the programming of the digital computer, which is substantially the same as described in connection with FIG. 4 except that an engine speed determination step is interposed between the required fuel amount calculation step and the transition determination step of FIG. 4. The computer program is entered repetitively at the point 260. At the point 262 in the program, a value is obtained for required fuel amount by calculating a value for basic fuel amount from an algebraic function describing a desired relationship between this controlled variable and engine operating conditions, and correcting the calculated basic fuel amount value for cylinder-head coolant temperature and other suitable engine operating conditions.

At the following point 264, a determination is made as to whether the engine speed is below a predetermined value, for example, of 2,000 rpm. If the answer to this question is "yes", then at the point 266, another determination is made. This determination is whether or not the engine operation is in transition. If the answer to this question is "yes", then the program proceeds to the point 268 where the calculated basic fuel amount value is corrected for acceleration or deceleration condition. Following this, the program proceeds to the point 270 where the corrected value is outputted to the injection drive circuit 50. If the determination at the point 264 or 266 is "no", then at the point 270, the calculated required fuel amount value is outputted to the injection drive circuit 50.

It is apparent that there has been provided, in accordance with this invention, a method and apparatus for eliminating the engine operating instabilities in the acceleration and deceleration mode of engine operation to obtain equilibrium conditions of engine operation at all times when used in an internal combustion engine having at least one cylinder adapted to suck, during an intake stroke of the cylinder, the fuel supplied in a plurality of instalments. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A method for controlling an internal combustion engine, said engine having an output shaft, means for controlling the amount of fuel supplied to said engine, and at least one cylinder adapted to intake, during each intake stroke of said cylinder, fuel supplied in a plurality of installments, said method comprising the steps of:

(a) generating electrical signals indicative of conditions of said engine while said engine is in operation;

(b) repetitively arithmetically calculating a value corresponding to a setting of said means for controlling the amount of fuel supplied to said engine, said calculation being carried out in a digital computer connected to receive said electrical signals and operable, under program control, for:

(1) arithmetically calculating a basic value from an algebraic function describing a desired relationship between said engine conditions and said basic value;

(2) detecting engine acceleration and deceleration conditions from changes in said engine conditions; and (3) adding a variable value expressed by $K(m_o-X)$ to said calculated basic value to modify said calculated basic value when engine acceleration or deceleration is detected, wherein K is a positive constant, $m_o$ is said calculated basic value, and X is one of (i) a value, $m_b$, calculated by the preceding calculation made in said step of arithmetically calculating a basic value from an algebraic function describing a desired relationship between said engine conditions and said basic value; and (ii) a value, $M_b$, calculated by the preceding calculation made in said step of calculating a value corresponding to a setting of said means for controlling the amount of fuel supplied to said engine;

(c) converting said calculated setting value into a setting of said means for controlling the amount of fuel supplied to said engine; and (d) while said engine is in operation, continuously repeating the above sequence of steps at uniform angular intervals of rotation of said engine output shaft to effect changes in the settings of said means for controlling the amount of fuel supplied to said engine in response to changes in said electrical signals indicative of said engine conditions.

2. A method for controlling an internal combustion engine as set forth in claim 1, wherein X is $m_b$.

3. A method for controlling an internal combustion engine as set forth in claim 2, wherein said constant K is set to 1.

4. A method for controlling an internal combustion engine as set forth in claim 1, wherein said constant K is set to a positive value less than 1.

5. A method for controlling an internal combustion engine as set forth in claim 2, wherein said step of detecting engine acceleration and deceleration conditions from changes in said engine conditions includes the steps of: detecting a change of at least one of said engine conditions occurring in an interval; and comparing said detected change with a predetermined value.

6. A method for controlling an internal combustion engine as set forth in claim 5, wherein said step of detecting a change of at least one of said engine conditions occurring in an interval includes detecting a change of throttle position in an interval corresponding to a predetermined number of degrees of rotation of said engine output shaft.

7. A method for controlling an internal combustion engine as set forth in claim 5, wherein said step of detecting a change of at least one of said engine conditions occurring in an interval includes detecting a change of intake air flow in an interval corresponding to a predetermined number of degrees of rotation of said engine output shaft.

8. A method for controlling an internal combustion engine as set forth in claim 5, wherein said step of detecting a change of at least one of said engine conditions occurring in an interval includes detecting a change of said calculated basic value in an interval corresponding to a predetermined number of degrees of rotation of said engine output shaft.

9. A method for controlling an internal combustion engine as set forth in claim 5, wherein said step of detecting a change of at least one of said engine conditions occurring in an interval includes detecting a change of intake manifold pressure in an interval corresponding to a predetermined number of degrees of rotation of said engine output shaft.

10. A method for controlling an internal combustion engine as set forth in claim 1, wherein said step of calculating a value corresponding to a setting of said means for controlling the amount of fuel supplied to said engine includes annulling said steps of detecting engine acceleration and deceleration conditions from changes in said engine conditions and adding said variable value to said calculated basic value to modify said calculated basic value.

11. A method for controlling an internal combustion engine as set forth in claim 1, wherein X is $M_b$.

12. A method for controlling an internal combustion engine as set forth in claim 11, wherein said constant K is set to 1.

13. A method for controlling an internal combustion engine as set forth in claim 11, wherein said constant K is set to a positive value less than 1.

14. A method for controlling an internal combustion engine as set forth in claim 11, wherein said step of detecting engine acceleration and deceleration conditions from changes in said engine conditions includes the steps of: detecting a change of at least one of said engine conditions occurring in an interval; and comparing said detected change with a predetermined value.

15. A method for controlling an internal combustion engine as set forth in claim 14, wherein said step of detecting a change of at least one of said engine conditions occurring in an interval includes detecting a change of throttle position in an interval corresponding to a predetermined number of degrees of rotation of said engine output shaft.

16. A method for controlling an internal combustion engine as set forth in claim 14, wherein said step of detecting a change of at least one of said engine conditions occurring in an interval includes detecting a change of intake air flow in an interval corresponding to a predetermined number of degrees of rotation of said engine output shaft.

17. A method for controlling an internal combustion engine as set forth in claim 14, wherein said step of detecting a change of at least one of said engine conditions occurring in an interval includes detecting a change of said calculated basic value in an interval corresponding to a predetermined number of degrees of rotation of said engine output shaft.

18. A method for controlling an internal combustion engine as set forth in claim 14, wherein said step of detecting a change of at least one of said engine conditions occurring in an interval includes detecting a change of intake manifold pressure in an interval corresponding to a predetermined number of degrees of rotation of said engine output shaft.

19. A method for controlling an internal combustion engine as set forth in claim 11, wherein said step of calculating a value corresponding to a setting of said means for controlling the amount of fuel supplied to said engine includes annulling, when the engine speed is below a predetermined value, said steps of detecting engine acceleration and deceleration conditions from changes in said engine conditions and adding said variable value to said calculated basic value to modify said calculated basic value.

20. An apparatus for controlling an internal combustion engine having an output shaft, means for controlling the amount of fuel supplied to said engine, and at least one cylinder adapted to intake, during each intake stroke of said cylinder, fuel supplied in a plurality of installments, said apparatus comprising:

(a) means for generating electrical signals indicative of conditions of said engine;

(b) a control circuit for repetitively calculating values corresponding to settings for said means for controlling the amount of fuel supplied to said engine, said control circuit having a digital computer connected to receive said electrical signals and programmed to calculate a basic value from an algebraic function describing a desired relationship between said engine conditions and said basic value, detect acceleration and deceleration conditions from changes in said engine conditions, and add a variable value expressed by $K(m_o-X)$ to said calculated basic value to modify said calculated basic value when the engine acceleration or deceleration is detected, wherein K is a positive constant, $m_o$ is said calculated basic value, and X is one of (i) a value, $m_b$, calculated by the preceding calculation of a basic value from an algebraic function describing a desired relationship between said engine conditions and said basic value; and (ii) a value, $M_b$, calculated by the preceding calculation of values corresponding to settings for said means for controlling the amount of fuel supplied to said engine; and (c) an electric circuit coupled between said digital computer and said means for controlling the amount of fuel supplied to said engine, said electric circuit transforming the results of the repetitive calculations into adjustments of said means for controlling the amount of fuel supplied to said engine.

* * * * *